US006295767B1

(12) United States Patent
Barnhill, Jr. et al.

(10) Patent No.: US 6,295,767 B1
(45) Date of Patent: Oct. 2, 2001

(54) SECURITY HOUSING FOR VENDING MACHINES AND THE LIKE

(75) Inventors: Michael J. Barnhill, Jr., El Cajon; James T. Barnhill, Alpine, both of CA (US)

(73) Assignee: Icon Enclosures, Inc., El Cajon, CA (US)

( * ) Notice: Subject to any disclaimer, the term of this patent is extended or adjusted under 35 U.S.C. 154(b) by 0 days.

(21) Appl. No.: 09/283,227

(22) Filed: Apr. 1, 1999

(51) Int. Cl.[7] ..... E04H 1/12

(52) U.S. Cl. ..... 52/79.1; 52/64; 52/27.5; 52/36.2; 52/79.6; 109/5; 109/14

(58) Field of Search ..... 52/109, 64, 27.5, 52/36.2, 79.1, 79.6; 160/23.1; 109/15, 2, 5, 6, 7, 11, 14

(56) References Cited

U.S. PATENT DOCUMENTS

| | | | | |
|---|---|---|---|---|
| D. 371,206 | | 6/1996 | Priestley et al. . | |
| 436,668 | | 9/1890 | Leonard . | |
| 498,508 | | 5/1893 | Drummond . | |
| 3,063,496 | * | 11/1962 | Kessler | 52/27.5 |
| 3,470,658 | | 10/1969 | Orliac . | |
| 3,893,589 | * | 7/1975 | Mandell | 221/123 |
| 4,018,016 | | 4/1977 | Zale . | |
| 4,326,620 | * | 4/1982 | Felix et al. | 194/1 |
| 4,471,586 | | 9/1984 | Shuch et al. . | |
| 4,558,650 | * | 12/1985 | Berman | 109/24.1 |
| 4,642,959 | | 2/1987 | Swiech, Jr. et al. . | |
| 4,998,388 | | 3/1991 | Englehart . | |
| 5,016,391 | * | 5/1991 | Miller et al. | 49/70 |
| 5,108,166 | | 4/1992 | Klix . | |
| 5,226,266 | | 7/1993 | Cernuto . | |
| 5,363,608 | | 11/1994 | Conlan . | |
| 5,509,225 | | 4/1996 | Minh et al. . | |
| 5,526,615 | * | 6/1996 | Kaizu et al. | 52/79.6 |
| 5,592,779 | * | 1/1997 | Conway | 52/64 X |
| 5,697,519 | * | 12/1997 | Wittern, Jr. et al. | 221/76 |
| 5,769,011 | * | 6/1998 | Daniel | 109/7 |
| 5,860,714 | * | 1/1999 | Skord, Jr. | 312/242 |
| 5,996,841 | * | 12/1999 | Marrocco | 221/268 |

FOREIGN PATENT DOCUMENTS

| | | | | |
|---|---|---|---|---|
| 87 13 547 | | 2/1988 | (DE) . | |
| 405051970 | * | 3/1993 | (JP) | 52/79.1 |
| WO 98/45820 | | 10/1998 | (WO) . | |

* cited by examiner

*Primary Examiner*—Beth A. Stephan
*Assistant Examiner*—Phi Dieu Tran A
(74) *Attorney, Agent, or Firm*—Brown, Martin, Haller & McClain LLP

(57) ABSTRACT

A portable security housing is formed from a framework defining an interior space for enclosing items to be secured, such as vending machines. The framework has a rear wall, opposite side walls, an upper wall, and a front access opening. Opaque panels are secured over at least the side and upper walls to cover the housing, with the rear wall placed against a building wall or the like. A roll-up, sectional door is rotatably mounted at the upper end of the front access opening for movement between a rolled up, storage position above the front opening and an unrolled, downwardly extended deployed position covering and closing the front opening. The housing has floor mounting pads at its base for releasably mounting the housing on a floor or ground surface.

14 Claims, 3 Drawing Sheets

SECURITY HOUSING FOR VENDING MACHINES AND THE LIKE

BACKGROUND OF THE INVENTION

The present invention relates generally to a security housing or enclosure, and is particularly concerned with a security housing for one or more outdoor vending machines to provide protection from vandalism, theft, and the elements.

Vandalism of outdoor automatic vending machines, and thefts from such machines, are relatively common during time periods when there is not much activity, such as late at night. In order to reduce vandalism and theft, some vending machines are enclosed in cages which have appropriate openings to allow customers to deposit money and select and retrieve products, but which prevent close access to the machine. However, this arrangement does not prevent vandalism, since vandals can reach between the bars with various tools and cause damage or deface the machine surfaces.

U.S. Pat. No. 5,526,615 of Kaizu et al. describes a booth or housing for enclosing an automatic transaction machine such as an automatic teller or ATM. A generally rectangular booth has a customer area and a machine area separated from the customer area by fixed partitions. Two automatic transaction machines are mounted in the machine area with access from the customer area, and two separate doors are provided for access to the respective machines.

SUMMARY OF THE INVENTION

It is an object of the present invention to provide a new and improved security housing or enclosure for securing items such as vending machines outdoors or in other publically accessible areas.

According to the present invention, a portable security housing is provided which comprises a framework defining an interior space for enclosing items such as vending machines, the framework having a rear wall, opposite side walls, a roof, and a front access opening having an upper end and opposite, parallel sides, opaque panels secured over at least the side walls and roof to cover the housing, a roll-up, sectional door rotatably mounted at the upper end of the access opening for movement between a rolled-up, storage position and a downwardly extended, deployed position closing the front access opening, a locking device for releasably locking the door in the deployed position, whereby objects inside the housing are not visible from outside the housing when the door is deployed, and the framework having a base with a plurality of mounting tabs on the base on the inside of the housing for securing the housing to a ground or floor surface.

Preferably, the door comprises a corrugated or sectional metal panel or tambour door, and spindle or mounting axle is rotatably mounted across the upper end of the door opening and secured to an upper end of the door. A motor is linked to the door mounting axle for rotating the axle to raise and lower the door. A key for operating a door motor switch is preferably provided on the outside of the housing, to permit an operator to raise and lower the door, for example by rotating the key in opposite directions. When the door is lowered into the deployed position, it will be closed and locked, and cannot be raised except by authorized personnel with a key. Alternatively, the door may be actuated remotely in a similar manner to remote controlled garage doors.

In a preferred embodiment of the invention, the housing is of predetermined dimensions to enclose one or two vending machines facing the front access opening, which has a width equal to or slightly greater than twice the width of a vending machine. The framework is of steel tubing or steel bar construction, and is preferably of generally rectangular cross-section with the longer sides forming the rear wall and front opening, and the shorter sides being rounded and forming generally arcuate or curved side walls to the enclosure.

The rear wall of the housing may be left open if the housing is deployed with the rear wall against the wall of a building or other immovable object. If it is to be used alone as a single, stand-alone unit, a rear wall panel is secured across the rear wall of the framework. In another alternative arrangement, two housings may be attached together back-to-back, to create a free-standing vending island.

The rounded, side wall panels of the housing may be used for advertising or the like, and can be changed or replaced for service, repairs, or to update graphics or advertisements. The housing is modular and is lightweight and of small enough dimensions to be moved through doorways or into confined areas.

The security enclosure or housing of this invention can house up to two vending machines and will protect the machines from the elements if deployed outdoors. The door can be closed and locked during times when the machines are unsupervised or when no-one is normally present in the area, such as late at night. This will considerably reduce or eliminate the risk of theft and vandalism. The machines will not be visible when the door is closed and locked, and thus they will be less likely to attract the attention of a potential vandal or thief. This invention will permit vending machines to be used in areas not normally suited for vending, such as schools that only allow vending to be accessible at certain monitored times of day. The door locking mechanism may be designed to be operated manually with a key at the site, or remotely via modem, or by a timer or other remote control device such as an actuator of the type used on automatic garage door openers.

BRIEF DESCRIPTION OF THE DRAWINGS

The present invention will be better understood from the following detailed description of a preferred embodiment of the invention, taken in conjunction with the accompanying drawings in which like reference numerals refer to like parts and in which.

DESCRIPTION OF THE PREFERRED EMBODIMENT

Figure 1:
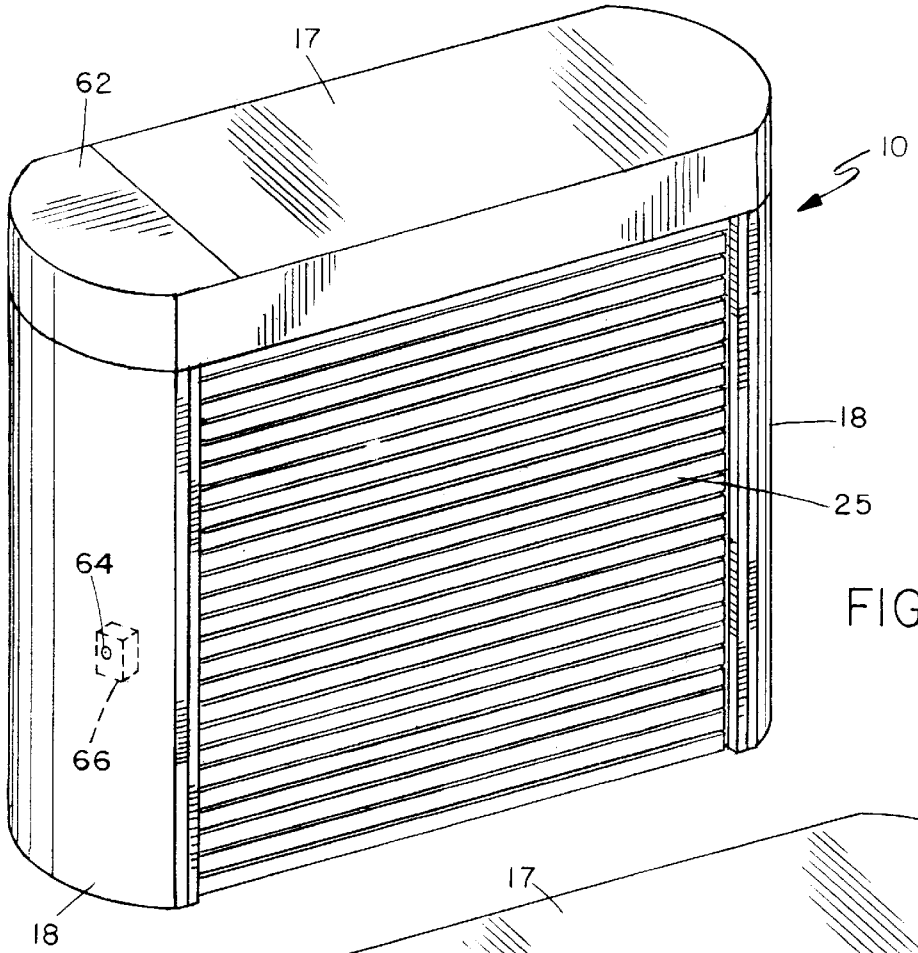
FIG. 1 is a perspective view of the security housing according to a preferred embodiment of the invention with the door closed.
Figure 2:
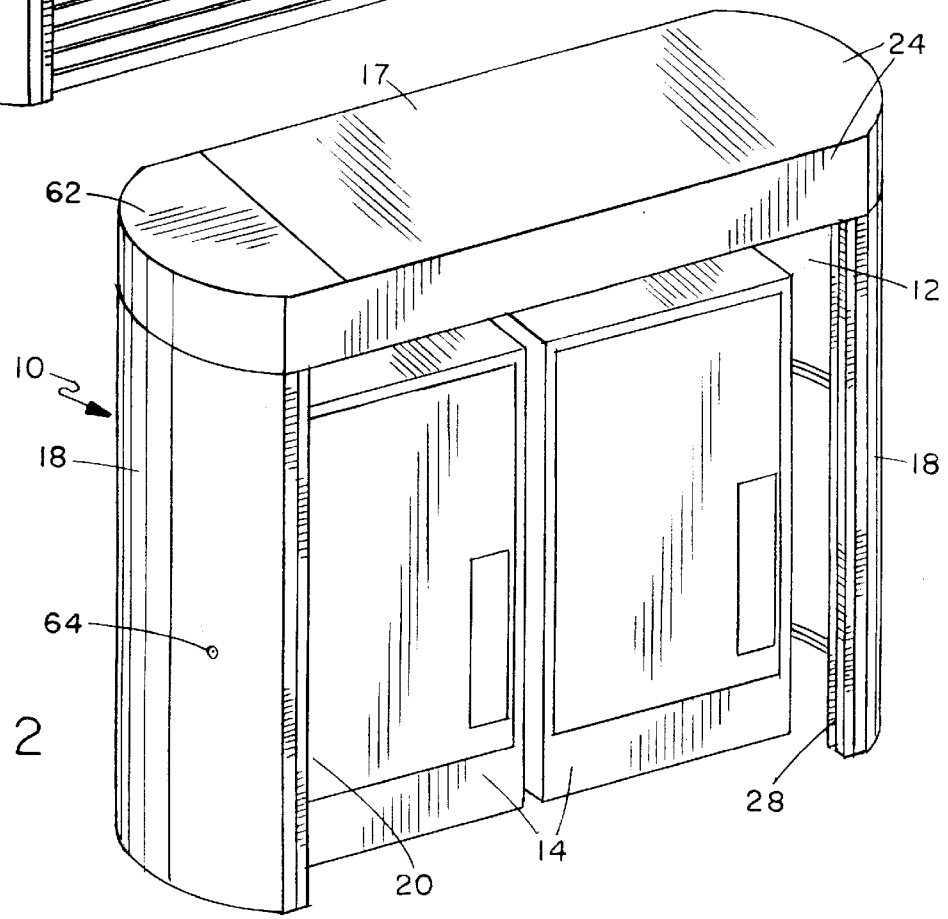
FIG. 2 is a similar view with the door open.

FIGS. 1 to 5 of the drawings illustrate a security housing or enclosure 10 according to a preferred embodiment of the invention. In the illustrated embodiment, the housing is dimensioned to define an interior space 12 sufficient to hold two typical vending machines 14 positioned side-by-side, as illustrated in FIG. 2. However, it will be understood that the housing may alternatively be dimensioned to hold only one vending machine for certain applications, or more than two machines. The security housing may also be used in other applications where security is required, for example to restrict access to lockers, mailboxes, ATM machines, or the like, or may simply be used for general storage purposes.

Figure 3:
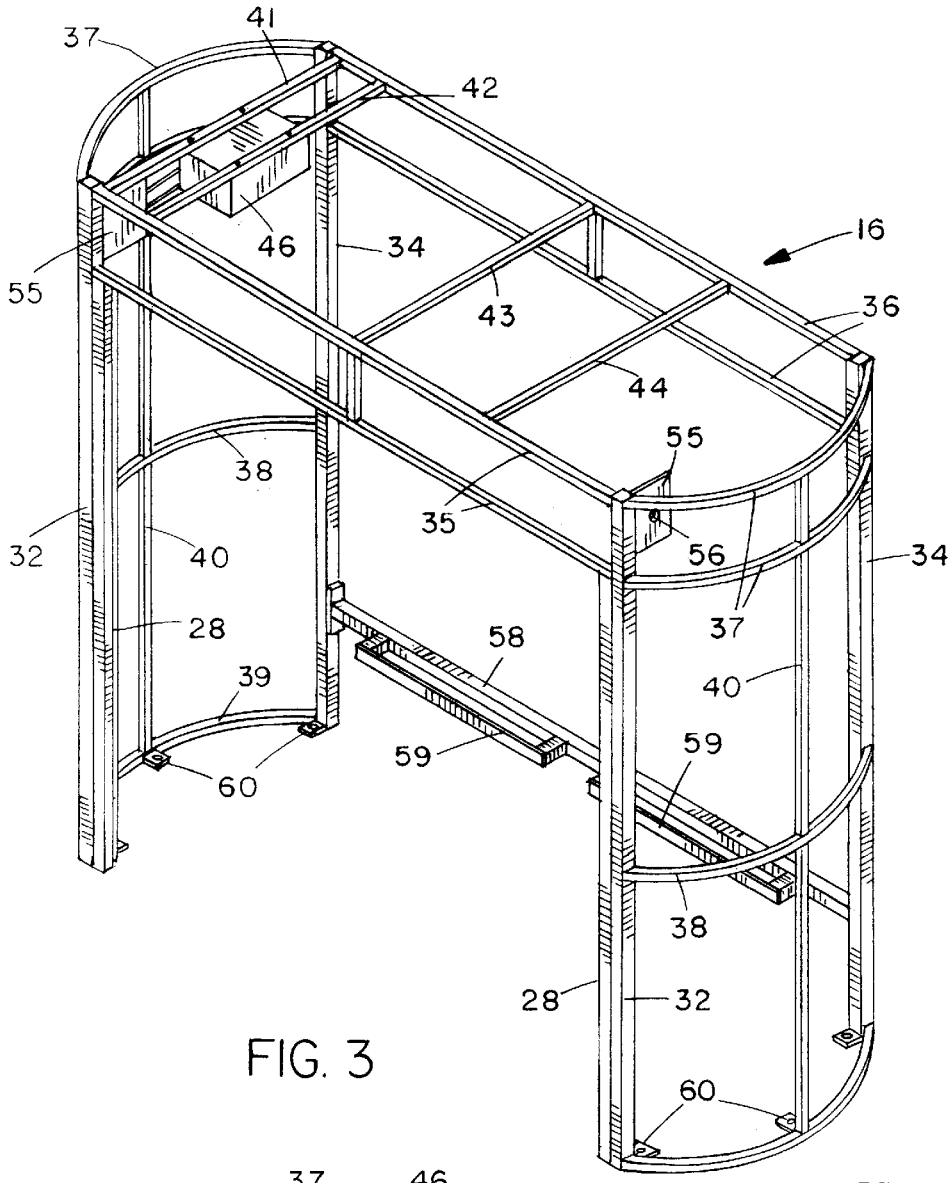
FIG. 3 is a perspective view of the inner frame of the housing.

The housing 10 is of generally rectangular cross-section with a generally flat rear wall 16, flat roof or top wall 17, rounded side walls 18, and a front opening 20 for access to the machines 14. As best illustrated in FIG. 3, the housing is constructed from an open framework 22 of metal tubing such as steel defining the shape or skeleton of the enclosure. Sheet metal panels 24 are then secured over the open sides, top or roof, and above the front opening 20, using tamper-proof screws (not illustrated). If the housing is to be deployed against a building wall or other fixed structure, panels need not be secured across the rear wall of the housing. However, if it is to stand alone, sheet metal panels will also be secured across the rear of the framework.

Figure 5:
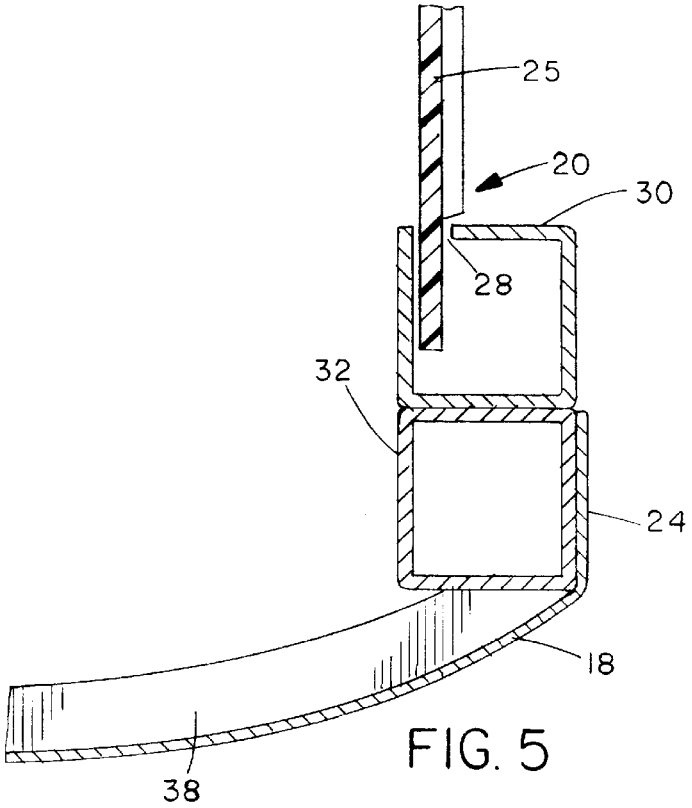
FIG. 5 is an enlarged sectional view taken on line 5—5 of FIG. 4.

A sectional or corrugated sheet metal door panel 25 has an upper end secured to a door axle or roller 26 rotatably mounted inside the top of the housing at the top of the front opening 20. Rotation of the axle 26 in a first direction will roll up the door panel 25 onto the axle into a storage position in which the front opening 20 is open, as in FIG. 2. Rotation of axle 26 in the opposite direction will unroll the panel and deploy it downwardly into the deployed, closed position of FIG. 1. Guide channels or grooves 28 in the framework on opposite sides 30 of the door opening act to guide the opposite edges of the door panel as it is deployed and retracted, as best illustrated in FIG. 5.

The housing framework will now be described in more detail with reference to FIG. 3. The framework is preferably constructed of welded steel bars or tubing. Two pairs of upright steel bars or struts 32,34 of larger cross-sectional dimensions are provided at the opposite sides of the front opening 20, and at the rear wall 16, respectively, forming four "corners" of the structure. A pair of spaced bars 35 extend between the upper ends of the upright struts 32 across the top of front opening 20, while a similar pair of spaced horizontal bars 36 extend between the upper ends of the upright struts 34 at the rear of the housing. A pair of arcuate upper bars 37, a central bar 38, and a lower bar 39 arch outwardly between the front and rear upright 32,34 at each side wall to define the curved shape of the side walls. Vertical cross bars 40 extend between the arcuate bars 35,36,38,39 at the center of each side wall 18.

Figure 4:
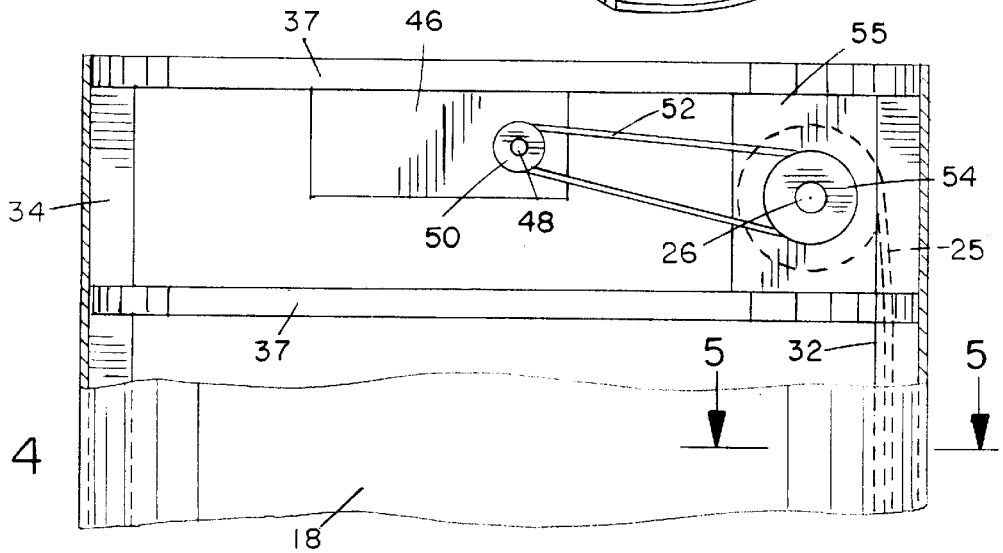
FIG. 4 is an enlarged side view of the upper portion of the housing; with the outer panel cut away to show the door drive mechanism.

Cross bars 41,42,43,44 extend between the upper bars 35 and 36 at the upper wall of the housing. The cross bars 41,42 form mounting bars for supporting a motor housing 46 for a door drive motor, as best illustrated in FIGS. 3 and 4. A drive shaft 48 projects from the housing and is linked to the door axle or roller 26 via drive sprocket 50, chain 52, and driven sprocket 54 on the door axle 26, as illustrated in FIG. 4. A pair of door mounting plates 55 are mounted at the upper ends of the two front upright struts 32, and the opposite ends of door axle 26 extend rotatably through aligned openings 56 in the mounting plates 55. The height of the housing is greater than the height of the vending machines 14, as can be seen in FIG. 2, to leave a space or upper chamber in the housing above the machines for housing the motor and door assemblies.

A back spreader bar 58 extends between the rear upright struts 34 towards the lower end of the housing, and has two rails or stops 59 inside the enclosure for positioning the two vending machines 14. Three floor mounting tabs 60 are provided inside each side wall at the lower end of the housing, projecting inwardly from opposite ends and the center of the arcuate bar 39. The flat tabs or pads 60 each have an opening for bolting the housing to the ground or floor, releasably securing the housing in any desired position.

Sheet metal panels are secured over the cross bars 35 above opening 20, over the side walls defined by bars 37,38,39, and 40, and over the top cross bars 42,43,44. A separate access panel 62 is secured to the top of the housing to extend from bar 42 over the arcuate bar 37 at the adjacent side of the housing, as best illustrated in FIGS. 1 and 2. This provides access to the motor for maintenance and repair purposes. This panel can be opened or removed to allow a technician to do any necessary repair work. A rear panel is secured across the rear of the framework between uprights 34 if necessary, depending on the location where the housing is to be deployed.

A keyhole 64 for operating a switch assembly 66 linked to the drive motor assembly 44 is provided in one side wall 18 of the housing. This allows an operator to turn on the motor and either raise the door into a storage position to allow access to the machines 14, or to lower the door into a closed position when the machines are not to be used.

Figure 6:
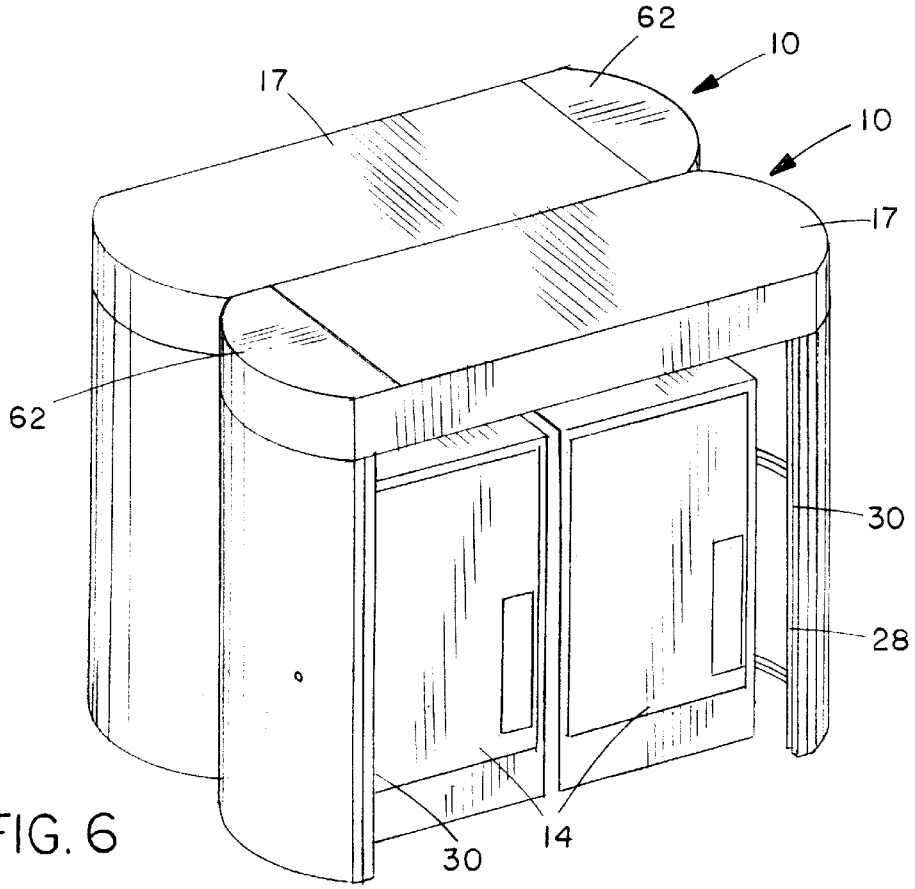
FIG. 6 is a perspective view showing two housings mounted back-to-back.

Installation and use of the housing will now be described in more detail. The housing is designed to be releasably floor or ground mounted at any desired indoor or outdoor location to secure one or more vending machines 14 enclosed within the housing. It may be installed with rear wall 16 located against a building wall or other fixed structure, in which case a rear panel will not be needed. If the housing is to stand alone, spaced from any fixed structure, a rear wall panel will be installed across the framework. Alternatively, two housings 10 may be secured together back-to-back, as illustrated in FIG. 6, to enclose and secure up to four vending machines, creating a free standing vending island. Once the location has been selected, the housing is secured to the ground or floor via bolts passed through openings in the floor mounting pads 60. The machines 14 are then installed inside the housing, and positioned against stop rails 59 in the position illustrated in FIGS. 2 and 6.

During time periods when use of the machines 14 is permitted, such as daytime or early evening, the corrugated or sectional door panel 25, also known as a tambour door, will be rolled up completely on roller or spindle 26 and concealed within the top of the housing above opening 20. During times when security is desired, i.e. when vandalism or theft is a major risk, such as outside business or school hours, the door can be lowered by actuating the motor by means of a key in keyhole 64, which turns the axle 26 in a first direction to unroll the door panel 25. The opposite sides of panel 25 will be guided down along tracks or channels 28 until the door is fully lowered, as illustrated in FIGS. 1,4, and 5. The motor is then turned off and the door will be locked in the deployed position until the motor is again actuated to rotate the axle 26 in the opposite direction, raising the door. Instead of a manual key operation as illustrated, the door may be actuated by a timer device, by a suitable remote control device, such as the type used in garage door openers, or remotely via modem linkage, for example.

The dimensions of the enclosure are selected according to the items to be enclosed, which are vending machines in the preferred embodiment. Preferably, the width of opening 20 is slightly greater than the width of the two side-by-side machines 14, although it may be smaller if only one machine is to be housed. The height of the housing is greater than the vending machine height to provide an upper chamber for locating the door actuating mechanism. The width of the housing from the front to the rear wall is preferably slightly greater than that of the vending machines 14, and in a preferred embodiment the housing width or depth was approximately 42 inches. The total length of the housing between the opposite side walls 18 was around 112 inches, while the width across opening 20 was around 88 inches. The height of the housing was around 98 inches, while the height of opening 20 was around 86 inches.

When the door is closed, the machines 14 will not be visible from outside the housing, removing the temptation for tampering or attempting to tamper with the machines. Access to the machines is effectively prevented by the housing walls and locked door, considerably reducing the risk of casual vandalism or attempts at theft. At the same time, the sheet metal panels forming the walls or skin of the housing protect the machines from the elements, if deployed outdoors. They also provide convenient surfaces for graphics decoration or advertising, and can be readily removed and replaced to allow for different ad campaigns, or in the event of damage.

The enclosure or housing of this invention is not a permanent structure, eliminating the need for any permits. It is relatively lightweight and portable, and can be moved through small doorways or into confined areas. The framework may be constructed in modules for ease of shipping and storage, and the modules may be welded together readily on site. For example, it may be constructed as two end modules and a top module. The steel tubing structure is of high strength, with the radiused side walls further increasing the strength of the framework.

Although a preferred embodiment of the invention has been described above by way of example only, it will be understood by those skilled in the field that modifications may be made to the disclosed embodiment without departing from the scope of the invention, which is defined by the appended claims.

We claim:

1. A portable security housing, comprising:

a framework defining an interior space;

the framework being of generally rectangular cross-section and having a rear wall, opposite side walls, an upper wall, and a front wall having a front access opening, the access opening having an upper end and opposite, parallel sides and being of predetermined width, the front and rear walls being larger than the side walls;

opaque panels secured over at least the side and upper walls to cover the housing;

a roll-up, sectional door rotatably mounted at the upper end of the front access opening for movement between a rolled up, storage position in the housing above the front opening and an unrolled, downwardly extended deployed position covering and closing the front opening, whereby objects inside the housing are not visible from outside the housing when the door is deployed;

a locking device for releasably locking the door in the deployed position;

the framework having a base, a plurality of mounting pads on the base for releasably securing the housing to the ground or floor beneath the housing; and at least two automatic vending machines arranged side-by-side with front faces facing the front access opening; the framework enclosing the two vending machines;

the width of the access opening being at least equal to the total width of the front faces of two side-by-side vending machines whereby the front faces are completely exposed to permit actuation of the vending machines only when the door is in the storage position.

2. The housing as claimed in claim 1, wherein the side walls are arcuate.

3. The housing as claimed in claim 1, wherein a spindle is rotatably mounted in the framework to extend across the opening above the upper end of the opening, the door has an upper end secured to the spindle and opposite sides, and guide channels are provided along the opposite sides of the front access opening for slidably guiding the opposite sides of the door as it moves between the storage and deployed positions.

4. The housing as claimed in claim 3, including a drive motor mounted in the housing adjacent the door spindle and linked to the door spindle for rotating the spindle in opposite directions to raise and lower the door, a door actuating switch for operating the motor linked to the motor, and a key receiving opening on the outside of the housing for receiving a key to operate the switch, the motor comprising said locking device.

5. The housing as claimed in claim 1, wherein the framework is of welded metal tubing construction.

6. A vending machine enclosure assembly, comprising:

at least one portable housing unit releasably secured to a ground or floor surface;

at least two vending machines separate from the housing unit enclosed side-by-side within the housing unit, each vending machine having a front face having means for actuating the vending machine, the front faces of the side-by-side vending machines having a first combined width, and the two vending machines together defining a first rectangular cross-sectional area; and the housing unit comprising a framework defining an interior space enclosing said at least two vending machines, the interior space being of predetermined, rectangular cross-sectional area matching and slightly greater than the first rectangular cross-sectional area of the machines to be enclosed, the framework having a rear wall, opposite side walls, an upper wall, and a front wall with a front access opening, the vending machines being positioned with their front faces facing and aligned with said front access opening, opaque panels secured over at least the side and upper walls to cover the housing, a door movable between an open position providing access through the front access opening to the front faces of the vending machines and a closed position concealing and preventing access to the machines, the front opening being of predetermined width at least equal to said first combined width of said vending machine front faces, whereby said front faces are exposed and accessible when said door is in the open position, and a locking device for locking the door in the closed position;

whereby said vending machines can only be operated through said access opening when said door is in the open position and said vending machines are inaccessible and cannot be operated when said door is locked in said closed position.

7. The assembly as claimed in claim 6, wherein a second housing unit is secured back-to-back with said one housing unit such that the front access opening of each housing unit faces outwardly away from the other housing unit, two additional vending machines being enclosed in said second housing unit with their front faces facing and aligned with the front access opening of said second housing unit.

8. The assembly as claimed in claim 6, wherein the framework has flat front and rear walls and rounded side walls.

9. The assembly as claimed in claim 6, wherein the housing unit has a height greater than that of a vending machine to leave an upper chamber in the housing above the vending machines, a roller rotatably mounted in the upper chamber above the front access opening, and the door comprising a sectional panel having an upper end secured to the roller and movable between a storage position in which the entire door panel is rolled up onto the roller, and a deployed position in which the door panel is rolled off the roller downwardly to cover the front access opening.

10. The assembly as claimed in claim 9, including a drive motor mounted in the upper chamber and linked to the roller to rotate the roller in opposite directions to move the door between the storage position and the deployed position, and vice versa, the drive motor comprising said locking device.

11. The assembly as claimed in claim 10, wherein the opaque panel covering the upper wall of the framework includes an access door for access to the drive motor.

12. The assembly as claimed in claim 6, wherein the framework has a height of approximately 98 inches.

13. The assembly as claimed in claim 12, wherein the housing has flat front and rear walls each having a length of around 112 inches.

14. The assembly as claimed in claim 13, wherein the spacing between the front and rear walls is approximately 42 inches.

* * * * *